US006181298B1

(12) United States Patent
Strickland

(10) Patent No.: US 6,181,298 B1
(45) Date of Patent: Jan. 30, 2001

(54) TOP-FED QUADRAFILAR HELICAL ANTENNA

(75) Inventor: Peter C. Strickland, Ottawa (CA)

(73) Assignee: EMS Technologies Canada, Ltd., Ottawa (CA)

( * ) Notice: Under 35 U.S.C. 154(b), the term of this patent shall be extended for 0 days.

(21) Appl. No.: 09/377,052

(22) Filed: Aug. 19, 1999

(51) Int. Cl.[7] ..... H01Q 1/36
(52) U.S. Cl. ..... 343/895; 343/797
(58) Field of Search ..... 343/895, 850, 343/700 MS, 702, 852, 860, 700 R, 797, 795

(56) References Cited

U.S. PATENT DOCUMENTS

| | | | | |
|---|---|---|---|---|
| 3,906,509 | | 9/1975 | DuHamel | 343/895 |
| 4,011,567 | | 3/1977 | Ben-dov | 345/853 |
| 4,295,144 | | 10/1981 | Matta et al. | 343/895 |
| 4,554,554 | | 11/1985 | Olesen et al. | 343/895 |
| 4,686,536 | * | 8/1987 | Allcock | 343/700 MS |
| 4,780,727 | | 10/1988 | Seal et al. | 343/895 |
| 5,170,176 | * | 12/1992 | Yasunaga et al. | 343/895 |
| 5,255,005 | * | 10/1993 | Terret et al. | 343/850 |
| 5,329,287 | | 7/1994 | Strickland | 343/752 |
| 5,349,365 | * | 9/1994 | Ow et al. | 343/895 |
| 5,406,693 | * | 4/1995 | Egashira et al. | 343/895 |
| 5,521,610 | * | 5/1996 | Rodal | 343/797 |
| 5,604,972 | | 2/1997 | McCarrick | 29/600 |
| 5,635,945 | * | 6/1997 | McConnell et al. | 343/895 |
| 5,949,385 | * | 9/1999 | Asakura et al. | 343/702 |
| 6,011,524 | * | 1/2000 | Jervis | 343/895 |

OTHER PUBLICATIONS

C.C. Kilgus, "Resonant Quadrifilar Helix Design", The Microwave Journal, Dec. 1970, pp. 49–54.
Senglee Foo, "A Quadrifilar Helical Anenna for Low Elevation GPS Applications", The Microwave Journal, Jan. 1998, pp. 179–184.
Richard C. Johnson and Henry Jasik, Antenna Engineering Handbook, McGraw–Hill Book Company (Toronto 1984), pp. 28–6 to 28–11 and 28–19.
Richard C. Johnson and Henry Jasik, Antenna Engineering Handbook, McGraw–Hill Book Company (Toronto, 1984), pp. 13–19 to 13–20.

* cited by examiner

*Primary Examiner*—Don Wong
*Assistant Examiner*—Thuy Vinh Tran
(74) *Attorney, Agent, or Firm*—Pascal & Associates

(57) ABSTRACT

An improved top fed quadrafilar helical antenna that provides circular polarization with near uniform gain over the upper hemisphere. The antenna comprises a pair of crossed printed circuit boards with two feed lines and two horizontal arms per board and four piecewise linear conductors. Each arm is connected to a feed line and to the end of a conductor that is piecewise linearly attached to the edges of the crossed printed circuit boards.

7 Claims, 7 Drawing Sheets

TOP-FED QUADRAFILAR HELICAL ANTENNA

FIELD OF THE INVENTION

The invention relates to antennas and specifically to improved quadrafilar helical antennas.

DISCUSSION OF THE PRIOR ART

Top fed quadrafilar helical antennas are known in the art for their high circular polarization (CP) gain over most of the upper hemisphere. The top-fed type of the quadrafilar helix is one of the few antenna structures known to be capable of producing circular polarization with near uniform gain over the upper hemisphere. Thus, top-fed quadrafilar helical antennas are ideal for satellite communications terminals. Unfortunately, this type of antenna is expensive and difficult to manufacture. Different designs have been suggested for this type of antenna, however, none of these alternatives overcome this basic manufacturing problem.

A quadrafilar helical antenna is presented by Senglee Foo in the article "A Quadrafilar Helical Antenna for Low Elevation GPS Applications" published in *Microwave Journal* January 1998 issue. However, this antenna is bottom fed by a microstrip feed circuit and does not provide near uniform circular polarized gain above the horizon.

Kilgus, in "Resonant Quadrafilar Helix Design", published in *Microwave Journal* December 1970, shows a top fed quadrafilar helical antenna that has the desired characteristics noted above. Unfortunately, the design shown in the article is not only complicated, but also difficult and expensive to manufacture. Furthermore, the design is also fragile in that the helical conductors are subject to the vagaries of harsh environments.

U.S. Pat. No. 5,170,176 issued to Yasunaga et al, also discloses a top fed quadrafilar helical antenna. This design is illustrated in FIG. 1. However, this design again suffers from the drawbacks noted above. The skill required to produce the proper winding or the percentage of a revolution per quadrant that a conductor makes around the z-axis is high. There is no guarantee that each and every antenna produced will provide the same characteristics given that the winding will depend on the individual constructing the antenna. Furthermore, the helical conductors do not have any visible means of support and are therefore freely hanging. They can therefore be easily snagged and broken.

A fourth design, disclosed in U.S. Pat. No. 5,349,365 issued to Ow et al and illustrated in FIG. 2, is also a top fed quadrafilar design. However, the conductors in the Ow et al design are made from four metal strips radiating from a common center, each strip having been deformed to a helical pattern. While this design does provide a more rigid and therefore less fragile antenna, it is difficult and expensive to manufacture. Specifically, the skill involved in bending the individual strips at specific points to produce the winding required necessitates not only precision in the bend angle but also accuracy in where the bend is placed.

Another conventional design is shown in FIG. 3. In this design, four wires are wound around a cylindrical dielectric mandrel with an arbitrary small fraction of a turn or multiple turns on each winding, each wire forming a constantly flowing curve without straight sections. The windings start at the top of the mandrel at locations oriented 90 degrees apart on the top of the mandrel. The windings may extend to the bottom of the mandrel or to some distance above the bottom. Horizontal wires join the helical wires to centrally located coaxial cables which run from the bottom of the mandrel to the top. The horizontal wires introduce a zenith component to the field. The bottom ends of the coaxial cables are connected to a feed network which impedance matches to the cables and excites them with relative phases of 0,90,180 and 270 degrees. The skill and time required to insert the coaxial cables and wind the conductors on the cylindrical mandrel render this type of antenna unsuitable for low-cost, mass manufacturing processes.

As can be seen from FIG. 3 and as noted above, it is difficult to feed the coaxial cables within the antenna structure. Also, winding the helical conductors properly is difficult and time consuming.

What is therefore required is a low-cost, easy to assemble, top-fed quadrafilar antenna that provides high circular polarization (CP) gain over most of the upper hemisphere and near uniform circular polarized gain above the horizon.

SUMMARY OF THE INVENTION

The present invention overcomes the deficiencies identified in the prior art by providing a top fed quadrafilar helical antenna comprising a pair of crossed printed circuit boards with two feed lines and two horizontal arms per board and four piecewise linear conductors. Each arm is connected to a feed line and to a conductor that is piecewise linearly attached to the edges of the crossed printed circuit boards.

The invention provides for a top fed quadrafilar helical antenna comprising:

- at least two printed circuit boards, each board having:
  - a first feed network located on a front side of the board and substantially parallel and adjacent to a first side of a longitudinal axis of the board
  - a second feed network located on a back side of the board and substantially parallel and adjacent to a second side of the longitudinal axis of the board
  - a first horizontal arm extending from the longitudinal axis to a first outer edge of the board, said first arm being located on the front side of the board
  - a second horizontal arm extending from the longitudinal axis to a second outer edge, said second arm being located on the back side of the board and
  - a slot located substantially collinear with the longitudinal axis of the board
- and a plurality of linear conductors wherein
- each feed network is connected to a proximal or inner end of a horizontal arm
- each linear conductor is connected to a distal or outer end of a horizontal arm
- each linear conductor is wound around the outer edges of the at least two printed circuit boards in a helical manner
- each printed circuit board is crossed with at least one other printed circuit board by interlocking their respective slots.

In another embodiment, the invention provides a top fed quadrafilar helical antenna comprising:

- a pair of double-sided printed circuit boards, each board having:
  - a slot located substantially on a longitudinal axis of the board for interlocking with a mating slot on the other circuit board;
  - a pair of impedance matching transformers located adjacent and parallel to the longitudinal axis of each board, said transformers being located on opposite sides of the board; and two horizontal arms of a feed network, said arms having a distal end and a proximal end and each arm being located on opposite sides of the board and outwardly extending from the longitudinal axis of the board to a longitudinal edge of the board and connected at a proximal end to an impedance matching transformer; and a plurality of piecewise linear conductors, each conductor electrically connected to the distal end of an arm of the feed network wherein the pair of printed circuit boards are connected to each other in a crosswise fashion by means of the slot on one board interlocking with a slot on the other board the piecewise linear conductors are helically wound around a perimeter defined by the longitudinal edges of the crossed circuit boards.

Another embodiment of the invention provides a top fed quadrafilar helical antenna comprising:

four identical printed circuit boards, each board having:

a feed network adjacent to and substantially parallel to an inner edge of the board and located on a front side of the board a horizontal arm located on the front side of the board and extending from the feed network to an outer edge of the board, said arm being substantially parallel and adjacent to a top edge of the board a ground plane located on a back side of the board a plurality of positioning means to position and hold captive a conductor, each positioning means being disposed adjacent to the outer edge of the board attachment means for attaching and fixing the four identical printed circuit boards to each other such that all the inner edges coincide at a connection axis a plurality of piecewise linear conductors wherein each feed network is connected to a proximal end of a horizontal arm each linear conductor is connected to a distal end of a horizontal arm each linear conductor is wound around the outer edges of the four identical printed circuit boards in a helical manner.

In a further embodiment, the invention provides a multifilar helical antenna comprising:

at least three printed circuit boards, each board having:

at least three edges including a connection edge, a bottom edge, and an outer edge a feed network adjacent and substantially parallel to the connection edge a horizontal arm having a distal end and a proximal end extending substantially from the connection edge to the outer edge attachment means for attaching and fixing the at least three printed circuit boards to each other such that all the connection edges coincide at a connection axis a plurality of piecewise linear conductors wherein each feed network is connected to a proximal end of a horizontal arm each linear conductor is connected to a distal end of a horizontal arm each linear conductor is wound around the outer edges of the at least three printed circuit boards in a helical manner.

The advantages of the invention are numerous. The use of printed circuit boards provides a rigid structure which supports the piecewise linear conductors, making the antenna more robust. Also, the use of piecewise linear conductors wound around the perimeter of the circuit boards eliminates the need for curved sections, thereby removing the need for skilled workers to assemble the antenna. All the skill required to assemble the antenna is the ability to solder or connect the piecewise linear conductors to the horizontal arms of the feed network. Furthermore, the wires need not be pre-bent in a jig as with the antenna strips used in the prior art as shown in FIG. 2. The wire used in this invention is uncoiled and soldered into place without the need for precision cutting or bending. Manufacture of the circuit boards is well-known and the use of an etched feed network on the circuit boards further simplifies the manufacturing process by allowing well-known precision mass circuit board manufacturing techniques to be utilized. All of the above combine to improve the performance and lower the manufacturing costs for the top-fed quadrafilar helical antenna.

BRIEF DESCRIPTION OF THE DRAWINGS

A better understanding of the invention may be obtained by reading the detailed description of the invention below, in conjunction with the following drawings, in which.

DETAILED DESCRIPTION OF THE PREFERRED EMBODIMENT

Figure 1:
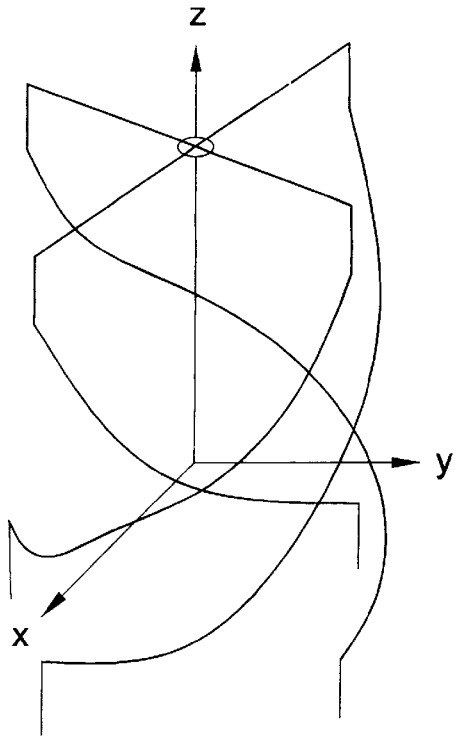
(PRIOR ART) FIG. 1
FIG. 1 is an oblique view of a quadrafilar helical antenna according to the prior art.
Figure 3:
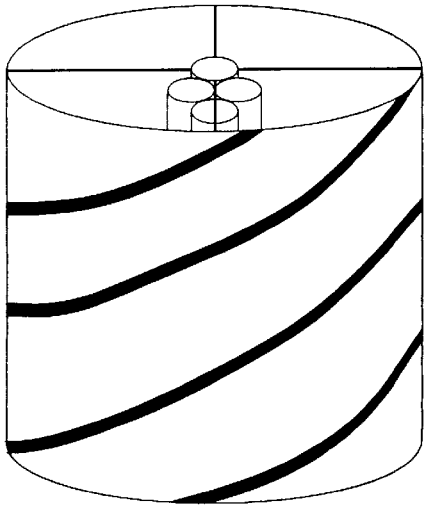
(PRIOR ART) FIG. 3
FIG. 3 is an oblique view of another quadrafilar helical antenna according to yet further prior art.
Figure 2:
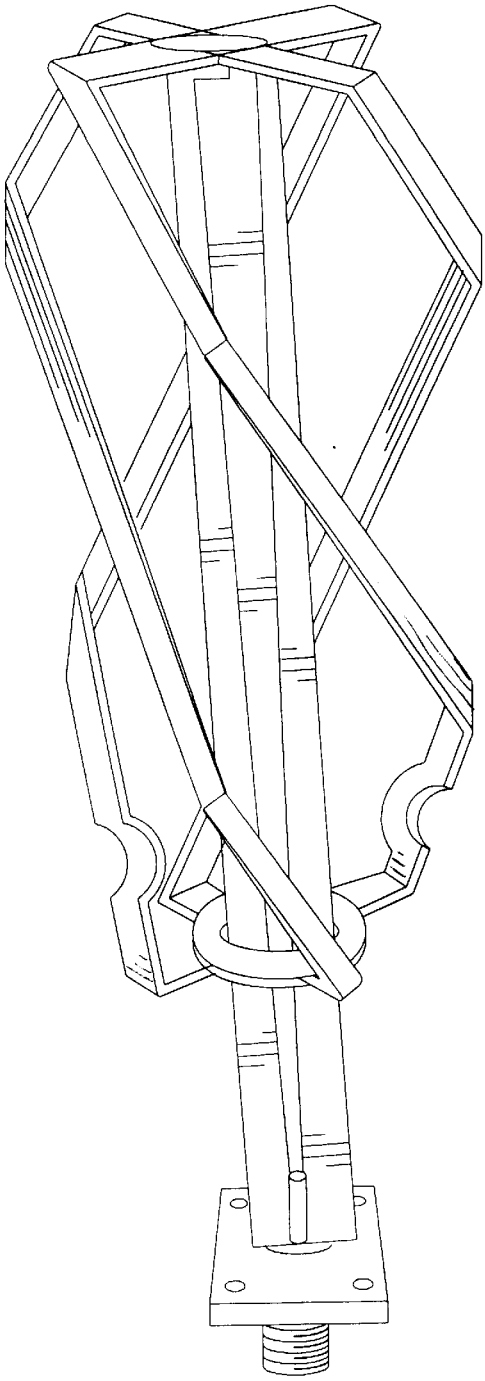
PRIOR ART FIG. 2
FIG. 2 is an oblique view of a quadrafilar helical antenna according to further prior art.
Figure 4:
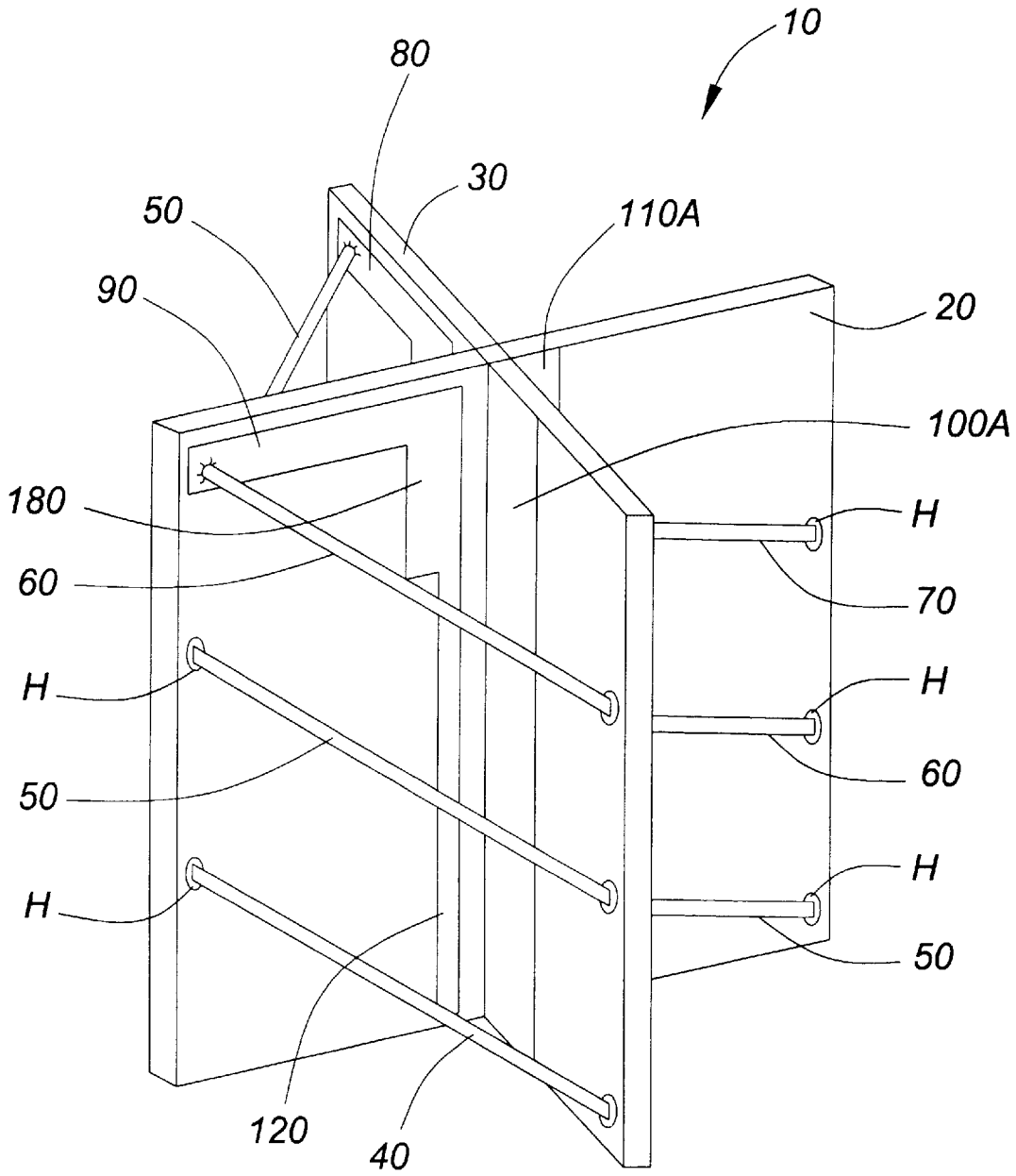
FIG. 4 is an oblique view of a quadrafilar helical antenna according to the invention.

Referring to FIG. 4, a top-fed quadrafilar helical antenna 10 is illustrated. Two rectangular printed circuit boards 20, 30 cross at their mid points. The boards are oriented at 90 degrees to each other and are locked into that position by well-known means such as mounting tabs on their bases. Four conductors 40, 50, 60, and 70 are wound around the crossed cards such that their trajectories are parallel and piece-wise linear. The two circuit boards 20, 30 have a total of four horizontal radiating arms 80, 90, 100, and 110 joining to vertical feed lines 120, 130, 140, and 150. Each wire is connected to a horizontal radiating arm. Thus, conductor 50 is connected to arm 80, conductor 60 is connected to arm 90, conductor 40 is connected to arm 110, and conductor 70 is connected to arm 100.

Figure 5:
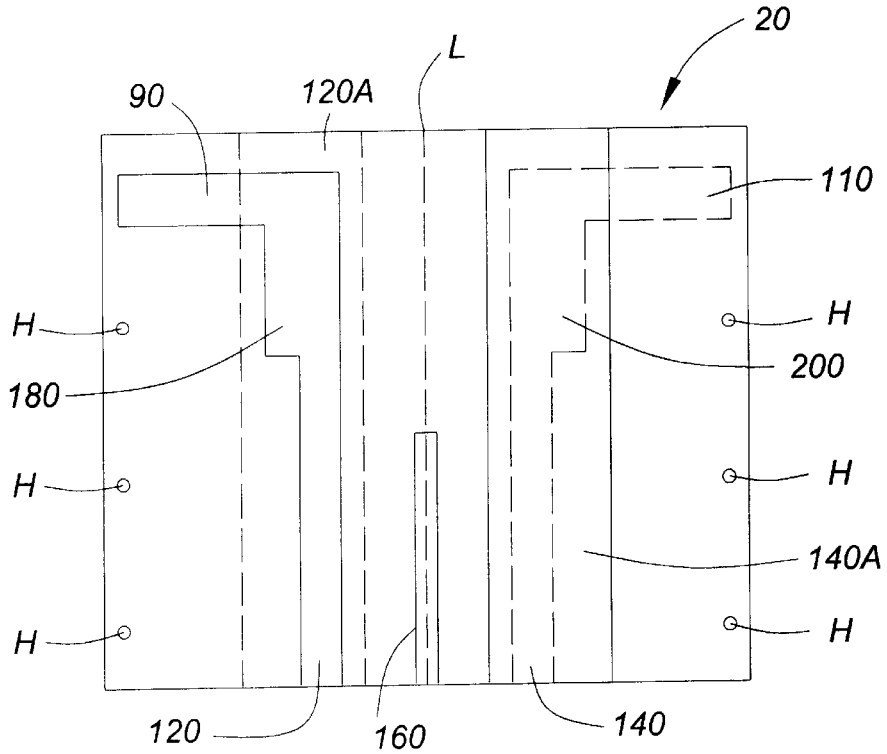
FIG. 5 is a front elevation view of a first circuit board according to the invention showing the front arm-feed line transformer combination and a first slot configuration.
Figure 6:
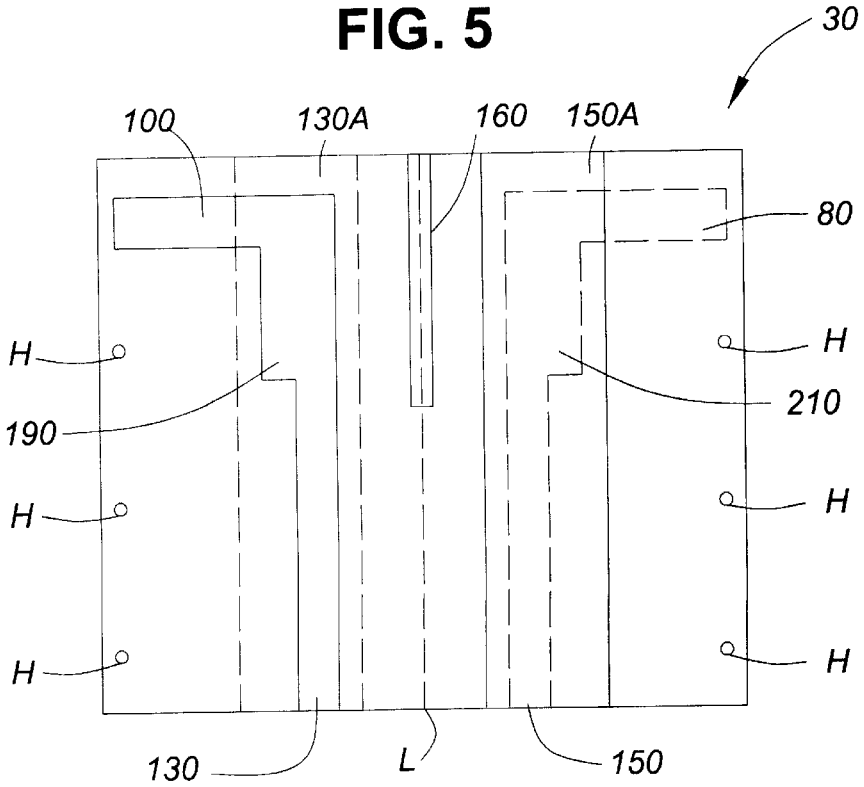
FIG. 6 is a front elevation view of a second circuit board according to the invention showing the front arm-feed line transformer combination and a second slot configuration.

The printed circuit boards 20 and 30 are joined by well-known means such as interlocking slots 160 and 170. A view of these slots is illustrated in FIGS. 5 and 6. In the slot configuration, a first slot 160 is cut from the center to bottom on a first circuit board 20. A second slot 170 is cut from top to center on the second circuit board 30. By interlocking these slots, the circuit boards are crossed at substantially 90 degrees to one another.

Figure 7:
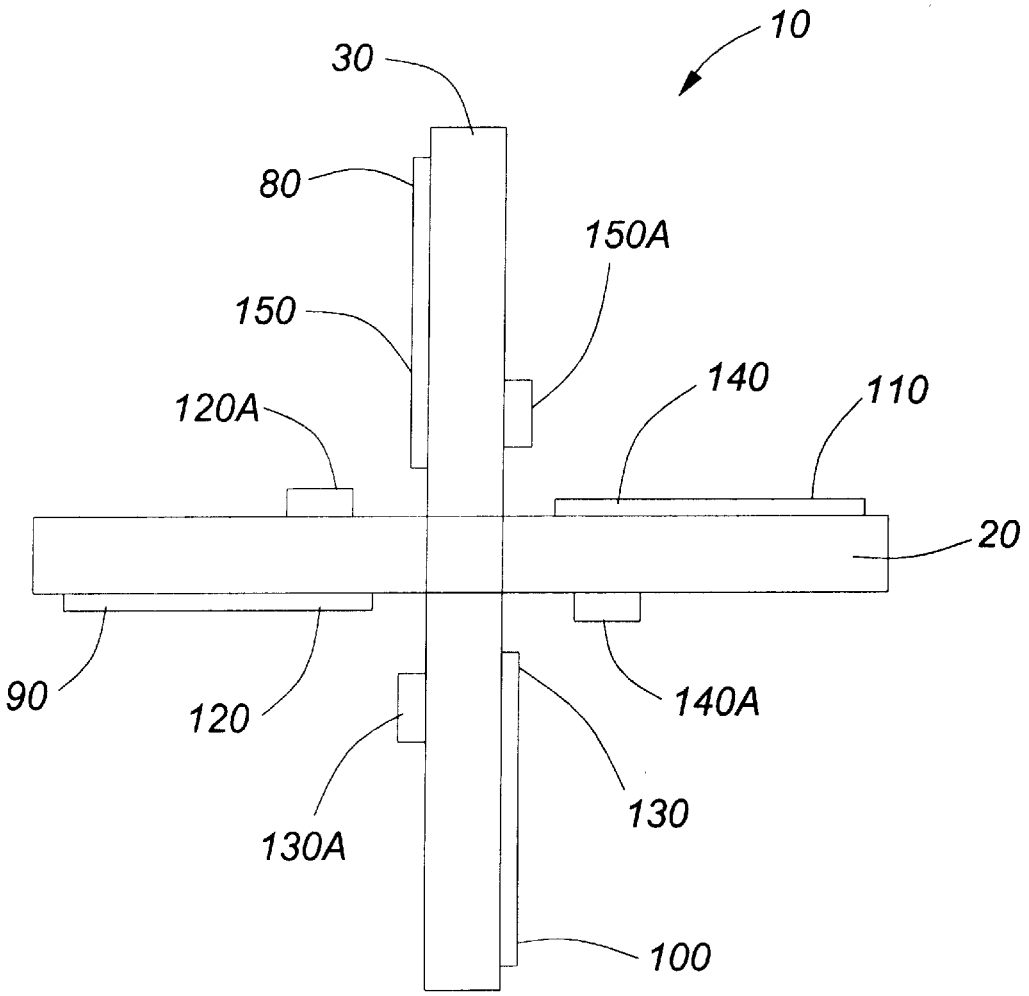
FIG. 7 is a plan view of the antenna of FIG. 4 with the conductors removed to show the arrangement of the front arm-feed line combinations.

As noted above, the horizontal radiating arms 80, 90, 100, 110 are joined to vertical feed lines 120, 130, 140, 150. The structure of the radiating arm-feed line is also illustrated in FIGS. 5 and 6. Note that on each board 20, 30 there are two arm-feed line combinations and that the arms and feed lines are symmetrical about their longitudinal axis L. This means that each side of a board 20, 30 has an arm-feed line combination and that the front arm-feed line combination is symmetrical about the longitudinal axis L to the back arm-feed line combination. However, it should be noted that this symmetry is not a mirror-image symmetry. For example, the front arm-feed line combination 90, 120 on the front of board 20, shown in FIG. 5, is not on the same side as the back arm-feed line combination 110, 140 on the back of the board 20. The dashed lines in FIGS. 5 and 6 represent the location, on the back of the boards 20,30, of the back arm-feed line combination corresponding to the front arm-feed line combination. Thus, the front arm-feed line combination 90, 120 corresponds to the back arm-feed line combination 110, 140 on board 20. Board 30 has a similar arrangement in that front arm-feed line combination 100, 130 corresponds to back arm-feed line combination 80, 150. With the boards 20, 30 assembled, a top cross-sectional view of the resulting structure, in effect a plan view of the antenna of FIG. 4 with the conductors removed for simplicity, is shown in FIG. 7.

It should further be noted that each arm-feed line combination has a corresponding impedance matching transformer. These transformers 180, 190, 200, 210 are integrated into the feed lines 120, 130, 140, 150.

The arm-feed line combination above allows for maximum flexibility in that the bottom ends of the feed lines 120, 130, 14, and 150 can be designed to be any desired impedance that is convenient for implementation of the required power divider. Such a power divider splits the input power equally into four branches, each branch corresponding to an arm-feed line combination and adjusts the relative phase of the four branches to be 0,90,180 and 270 degrees.

The horizontal radiating arms 80, 90, 100, 110, vertical feed lines 120, 130, 140, 150 and integral matching transformers 180, 190, 200, 210 are not conventional microstrip elements(thin metallic conducting patches etched on a grounded dielectric substrate) but are an alternative printed transmission line structure manufactured using conventional printed circuit board technology where the ground plane is mirror-image asymmetrical and the dielectric is mirror-image asymmetrical as well. Conventional microstrip elements would have a mirror-image symmetrical dielectric and a mirror-image symmetrical ground plane, with each board effectively having both arm-feed line combinations on the same side. In this case, there is mirror-image asymmetry of the placement of the vertical feed lines as explained above. Thus, a front arm-feed line combination has a ground plane on the back adjacent to a back arm-feed line combination. Correspondingly, each back arm-feed line combination has a ground plane on the front that is adjacent a front arm-feed line combination. These ground planes are referenced as 120A, 130A, 140A, and 150A in FIG. 7 and correspond to feed lines 120, 130, 140, and 150. These ground planes are shown further in FIGS. 5 and 6. A ground plane on one board is connected to the other ground plane on the same board by plated through holes on the board. The placement of these holes can be anywhere on the board as long as electrical contact between the ground planes are maintained.

Regarding the piece-wise linear conductors 40, 50, 60, 70, none of these have any curved sections as in conventional helix designs. These conductors may each make as little as ¼ turn or may each have some multiple of ¼ turn. Each conductor 40, 50, 60, 70 is connected by well-known means, such as soldering, to a horizontal radiating arm. For example, FIG. 4 shows that the conductor 60 connects to the radiating arm 90. These conductors 40, 50, 60, 70 are piecewise linearly wound around the perimeter of the crossed circuit boards 20, 30. The conductors pass through either holes or notches H appropriately located on the edges of the circuit boards 20, 30. This mechanism provides flexibility in allowing the number of turns to be controllable between different antennas. To have more turns around the perimeter, more holes or notches are installed with a corresponding space decrease between the notches and holes, and the conductors are lengthened. For less turns, the holes or notches are lessened with a corresponding space increase between notches or holes. Also, lesser turns around the perimeter necessitates shortening the conductors.

To terminate the conductors, each conductor is soldered into plated through holes at a bottom edge of a circuit board. These holes may either be grounded using well-known means or left open-circuit.

Figure 8:
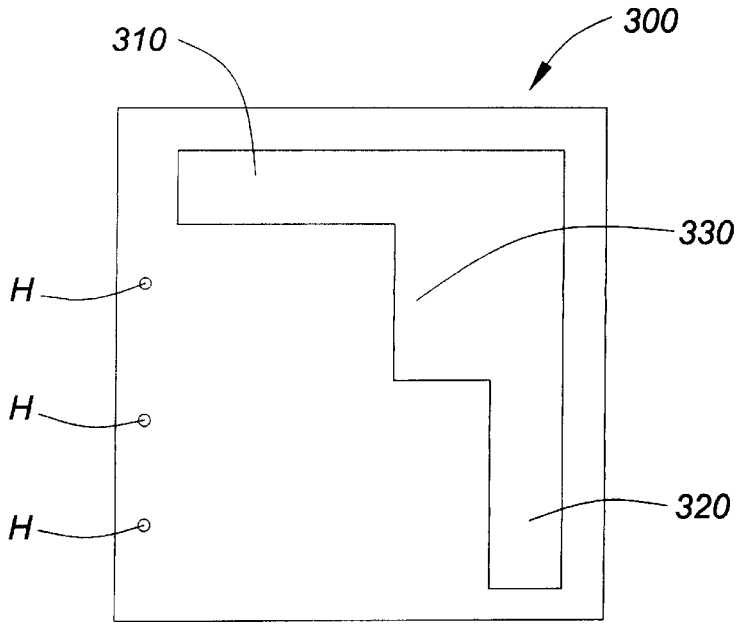
FIG. 8 is a front elevation view of a circuit board according to a second embodiment of the invention showing the arm-feed line transformer combination.

A second embodiment of the invention involves a similar concept of piecewise linear conductors wound around an antenna body. However, in this embodiment, the body comprises four separate circuit boards with each board acting as one half of a similar board described above. Referring to FIG. 8, a front elevation view of such a board 300 is presented. The board 300 has, similar to the boards 20, 30 described above, a radiating arm 310, a feed line 320, and a transformer 330. However, unlike boards 20, 30, there is no corresponding back arm-feed line combination for the front arm-feed line combination 310,320. A ground plane 320A is located on the back of the board 300.

Figure 9:
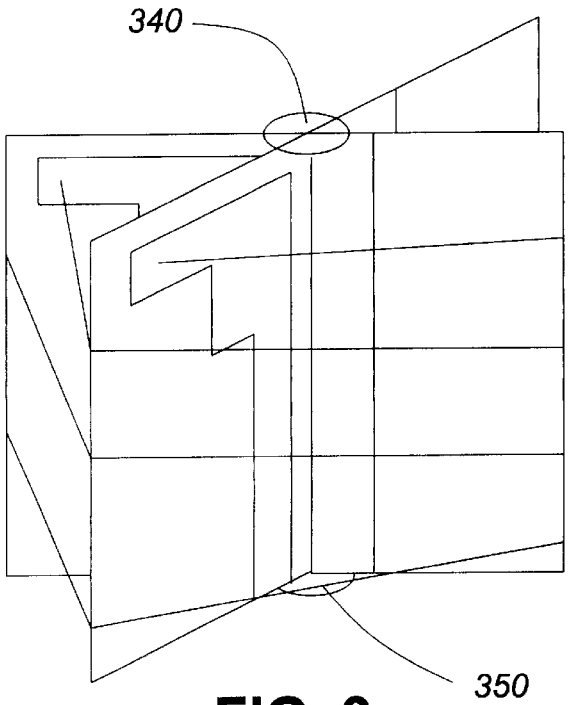
FIG. 9 is an oblique view of a quadrafilar helical antenna according to a second embodiment of the invention.
Figure 10:
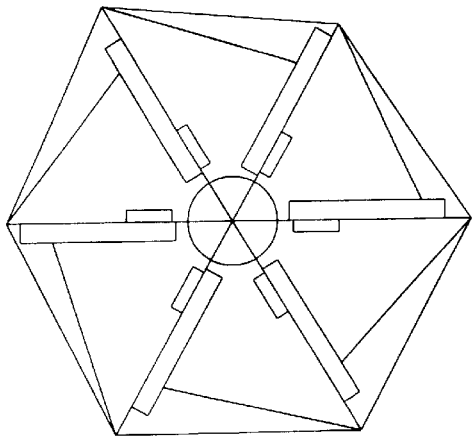
FIG. 10 is a plan view of a six board configuration according to the second embodiment of the invention.

In use, a multiplicity of boards similar to board 300 would be attached to one another to provide a body for the antenna. FIG. 9 shows a front elevation view of a four board configuration while FIG. 10 shows a plan view of a six board configuration. It should be clear that the number of boards dictate the number of piecewise linear conductors that are wound around the perimeter formed by the edges of the boards.

Figure 11:
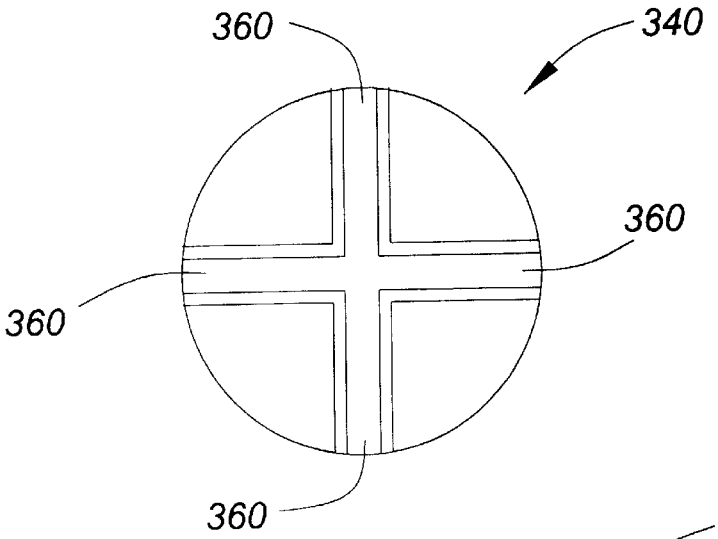
FIG. 11 is a plan view of a top piece of an attachment mechanism for use with the second embodiment of the invention.

To attach the boards to one another, a suitable mechanism is chosen. Such a mechanism must fix all the boards together in such a way that all the board edges adjacent to the feed line coincide at a single axis. One mechanism illustrated in FIG. 9 involves slotted top piece 340 and slotted bottom piece 350 with the number of slots determining the number of boards to be used. A plan view of the top piece 340 is illustrated in FIG. 11. An oblique view of the bottom piece

Figure 12:
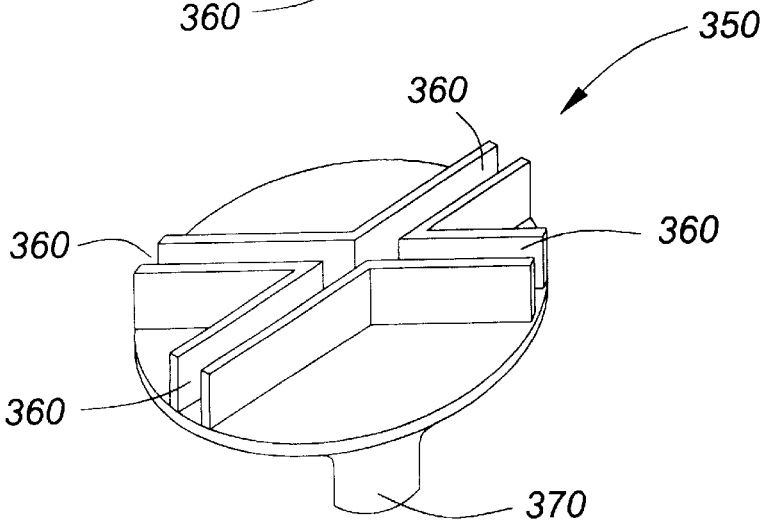
FIG. 12 is an oblique view of a bottom piece of an attachment mechanism for use with the second embodiment of the invention.

350 is illustrated in FIG. 12. The boards are inserted into the top and bottom slots 360 and are held captive by these slots. The bottom slotted piece 350 can incorporate a mechanism 370 to feed the four feed lines. It should be noted that the top and bottom pieces 340 and 350 illustrated are only for the four board configuration.

I claim:

1. A top fed quadrafilar helical antenna comprising:

at least two printed circuit boards, each board having:

a first feed network located on a front side of the board and substantially parallel and adjacent to a first side of a longitudinal axis of the board a second feed network located on a back side of the board and substantially parallel and adjacent to a second side of the longitudinal axis of the board a first horizontal arm extending from the longitudinal axis to a first outer edge of the board, said first arm being located on the front side of the board a second horizontal arm extending from the longitudinal axis to a second outer edge, said second arm being located on the back side of the board and a slot located substantially collinear with the longitudinal axis of the board and a plurality of linear conductors wherein each feed network is connected to a proximal or inner end of a horizontal arm each linear conductor is connected to a distal or outer end of a horizontal arm each linear conductor is wound around the outer edges of the at least two printed circuit boards in a helical manner each printed circuit board is crossed with at least one other printed circuit board by interlocking their respective slots.

2. A top fed quadrafilar helical antenna comprising:

a pair of double-sided printed circuit boards, each board having:

a slot located substantially on a longitudinal axis of the board for interlocking with a mating slot on the other circuit board;

a pair of impedance matching transformers located adjacent and parallel to the longitudinal axis of each board, each side of the board having one transformer; and two horizontal arms of a feed network, said arms having a distal end and a proximal end and each arm being located on opposite sides of the board and outwardly extending from the longitudinal axis of the board to a longitudinal edge of the board and connected at a proximal end to an impedance matching transformer; and a plurality of piecewise linear conductors, each conductor electrically connected to the distal end of an arm of the feed network wherein the pair of printed circuit boards are connected to each other in a crosswise fashion by means of the slot on one board interlocking with a slot on the other board the piecewise linear conductors are helically wound around a perimeter defined by the longitudinal edges of the crossed circuit boards.

3. An antenna as in claim 2 wherein said feed network and said transformers are printed on the circuit boards.

4. A top fed quadrafilar helical antenna comprising:

four identical printed circuit boards, each board having:

a feed network adjacent to and substantially parallel to an inner edge of the board and located on a front side of the board a horizontal arm located on the front side of the board and extending from the feed network to an outer edge of the board, said arm being substantially parallel and adjacent to a top edge of the board a ground plane located on a back side of the board a plurality of positioning means to position and hold captive a conductor, each positioning means being disposed adjacent to the outer edge of the board attachment means for attaching and fixing the four identical printed circuit boards to each other such that all the inner edges coincide at a connection axis a plurality of piecewise linear conductors wherein each feed network is connected to a proximal end of a horizontal arm each linear conductor is connected to a distal end of a horizontal arm each linear conductor is wound around the outer edges of the four identical printed circuit boards in a helical manner.

5. An antenna as in claim 4 wherein said feed network is printed on each circuit board.

6. A multifilar helical antenna comprising:

at least three printed circuit boards, each board having:

at least three edges including a connection edge, a bottom edge, and an outer edge a feed network adjacent and substantially parallel to the connection edge a horizontal arm having a distal end and a proximal end extending substantially from the connection edge to the outer edge attachment means for attaching and fixing the at least three printed circuit boards to each other such that all the connection edges coincide at a connection axis a plurality of piecewise linear conductors wherein each feed network is connected to a proximal end of a horizontal arm each linear conductor is connected to a distal end of a horizontal arm each linear conductor is wound around the outer edges of the at least three printed circuit boards in a helical manner.

7. An antenna as in claim 6 wherein each feed network is printed on each circuit board.

* * * * *